United States Patent [19]

Frunder et al.

[11] Patent Number: 5,067,404

[45] Date of Patent: Nov. 26, 1991

[54] METHOD AND APPARATUS FOR PRINTING BY INKING A LATENT THERMAL IMAGE

[75] Inventors: Henning Frunder, Munich; Manfred Wiedemer, Ismaning, both of Fed. Rep. of Germany

[73] Assignee: Siemens Aktiengesellschaft, Munich, Fed. Rep. of Germany

[21] Appl. No.: 555,406

[22] PCT Filed: Feb. 26, 1988

[86] PCT No.: PCT/DE88/00099

§ 371 Date: Aug. 21, 1990

§ 102(e) Date: Aug. 21, 1990

[87] PCT Pub. No.: WO89/08286

PCT Pub. Date: Sep. 8, 1989

[51] Int. Cl.[5] ..... B41L 35/14

[52] U.S. Cl. ..... 101/488; 101/467

[58] Field of Search ..... 101/488, 487, 467; 427/248.1, 256, 288, 53.1, 56.1

[56] References Cited

U.S. PATENT DOCUMENTS

| | | | |
|---|---|---|---|
| 3,128,198 | 4/1964 | Dulmage et al. | 430/97 |
| 3,162,104 | 12/1964 | Medley | 355/210 |
| 3,190,200 | 6/1965 | Limberger et al. | 355/256 |
| 3,446,184 | 5/1969 | Johnson | 118/423 |
| 3,745,235 | 7/1973 | Bestenreiner et al. | 101/467 |
| 3,793,025 | 2/1974 | Vraneken et al. | 430/294 |
| 4,311,723 | 1/1982 | Mugrauer | 427/14.1 |
| 4,514,744 | 4/1985 | Saitoh et al. | 346/153.1 |
| 4,718,340 | 1/1988 | Love, III | 101/467 |
| 4,930,417 | 6/1990 | Isobe | 101/467 |

FOREIGN PATENT DOCUMENTS 1252531 10/1967 Fed. Rep. of Germany .

OTHER PUBLICATIONS

Japanese Patent Abstract, vol. 8, No. 228 (P-308), [1665], 10/19/84 (11) 59-109067(A).

Japanese Patent Abstract, vol. 9, No. 224 (P-387) [1947], Sept. 10, 1985 (11) 60-80866(A).

IBM Technical Disclosure Bulletin, vol. 17, No. 5, 10/74, "Duplication Process Based on Ink Development of Latent Conductivity Pattern".

*Primary Examiner*—David A. Wiecking

*Assistant Examiner*—Stephen R. Funk

[57] ABSTRACT

A printer comprising a temperature control (A) that sets a recording medium (10) conducted through the printer under motor drive approximately uniformly to a predetermined temperature, comprising a thermal writer (B) that generates a latent character image on the recording medium (10) by local heat application controlled character-dependent, and comprising a developer (C) in which the latent character image is developed by condensation of a color vapor or by color application.

9 Claims, 1 Drawing Sheet

METHOD AND APPARATUS FOR PRINTING BY INKING A LATENT THERMAL IMAGE

Figure 1:
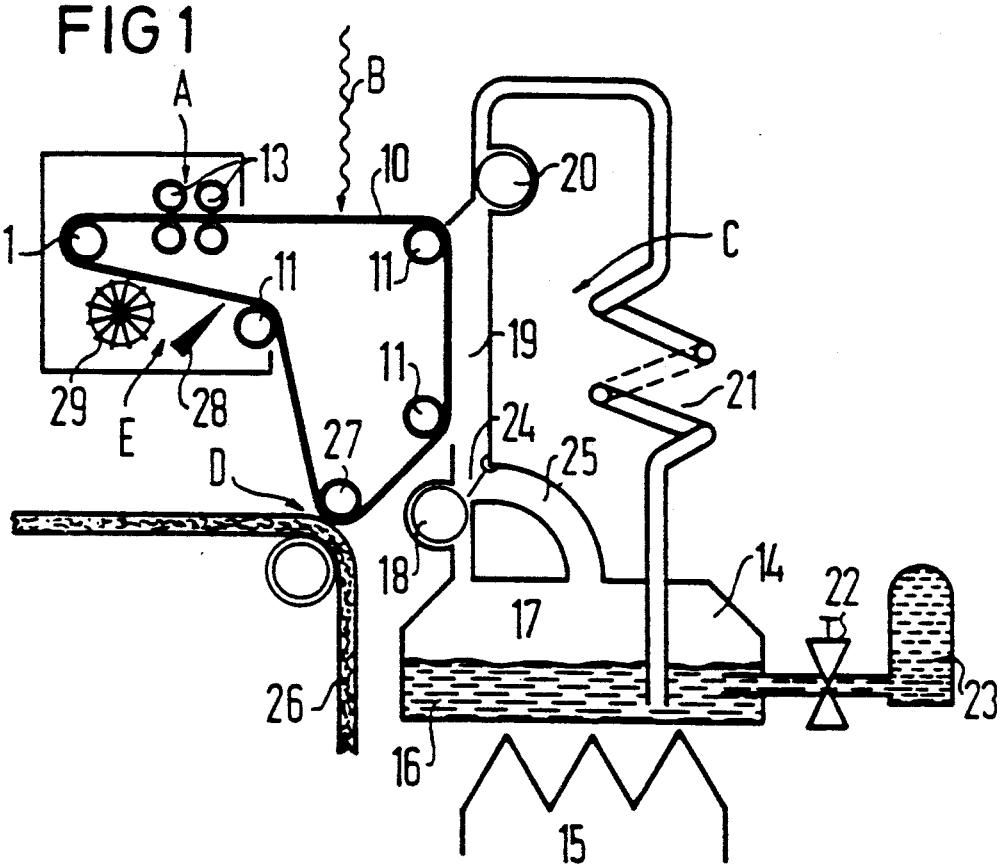

The invention is directed to a method and to an apparatus for printing by inking a latent thermal image.

Non-mechanical printing processes that are based on the electrophotographic or magnetophotographic principle are notoriously known and have been successfully employed. Such a printing process working according to the principle of electrophotography is disclosed, for example, by U.S. Pat. No. 4,311,723. A latent charge image is thereby produced on an electrostatically charged, photoconductive material, whether it is a photoconductor drum or a photoconductive belt, by a selective discharge with a light source modulated image-like. This charge image is then inked in a development station with electrically charged colorant particles (toner) and is subsequently transferred onto a recording medium, for example onto an endless paper web or onto an individual sheet, in a transfer printing station.

Such a charge image is developed either by applying dry toner or liquid toner.

In dry toner development, the charge of the colorant particles is triboelectrically generated by friction at what are referred to as carrier particles, usually iron, steel or ferrite, that also see to conveying into the proximity of the charge image on the basis of their magnetic adhesion to a rotating magnetic drum.

The charge of the colorant particles can also be produced by different methods, for example corona charging or by the polarization of the toner particles in the electrical field of the latent charge image itself. It is standard to employ a toner particle size of about 5 through 10 μm in order to obtain an acceptable relationship between the undesired adhesion forces of the toner particles to the photoconductor, carrier or conveyor means and the desired electrical switching forces.

In the liquid methods, the toner particles that are electrically charged by, for example, chemical charge separation, move in an insulating, organic carrier liquid, for example ISOPAR (Trademark of Exxon). Since undesired adhesion forces are compensated better, the colorant particles can thereby be significantly smaller.

A certain granularity of the image with negative consequences for extremely fine characters and for the transition region between image patterns and backgrounds (edge sharpness) arises in dry toner development due to the required particle size. Further, local electrical development fields cause an especially high particle application in these transition regions that can lead to visible image disturbances (over-tonering) and, consequently, to a poorer adhesion of the toner on the recording medium as well.

The elimination of the carrier liquid from the printer means together with the recording medium and the extremely great sensitivity of the particle application to fluctuations in the toner concentration in the carrier liquid are disadvantageous in the liquid developing processes.

The magnetographic principle is based on producing a latent magnetic image on a permanently magnetizable carrier medium. A defined iron part allows the single-component toner powder to adhere to the carrier medium magnetized in accord with the image. The transfer printing ensues with the assistance of pressure or magnetic field.

The granularity of the toner powder is disadvantageous in the electrophotographic processes. The iron/ferrite additive, moreover, makes it more difficult to produce brilliant hues.

U.S. Pat. No. 4,514,744 discloses an electrostatic copier means, whereby an opaque, thin layer is first applied onto a belt-shaped photoconductor. This layer is then removed character-dependent with the assistance of a thermal writing means, for example by evaporation. After the photoconductor is exposed, the photoconductor is inked with toner and a transfer printing onto recording medium ensues. The opaque layer is then removed from the photoconductor.

An object of the invention is to provide a nonmechanical printing method and a printing means that enable a printed format having high resolution and high color saturation to be produced with high printing speed on a recording medium, whether it be endless paper or single sheets.

This object is achieved by a printing process in which a medium that is movably guided in a printer is brought to a uniform temperature, a latent thermal character image is produced on the medium with a writing means that is controlled character-dependent, and the latent thermal character image is developed in a development station by condensation of a colored vapor or by separate inking after condensation of a vapor, whereby the condensation behavior of the vapor and the temperature of the medium are selected such that the vapor precipitates on the medium character-dependent.

The object may also be achieved by a printing process wherein a medium is movably guided in a printer and is brought to a uniform temperature, an oleophilic or hydrophilic molecular liquid film is applied on the medium, a latent character image is produced on the medium by selective evaporation of the liquid film with a thermal writing means controlled character-dependent, and the latent character image is developed in a development means by inking upon utilization of the condensation of a vapor or by direct color transfer with a mechanical application means.

A printing apparatus for achieving the object of the invention includes a temperature control means for setting a medium guided through the printer means to an approximately uniform predetermined temperature, a thermal printing means for generating a latent thermal character image by a local application of heat onto the medium that is controlled character-dependent, and a development means for developing a latent thermal character image by condensation of a colored vapor or by separate inking after condensation of a vapor.

The object of the invention may alternately be achieved by a printer apparatus including a temperature control means for setting a medium guided through the printer means to an approximately uniform predetermined temperature, a wetting means for producing a thin oleophilic or hydrophilic liquid film on the medium that is arranged before a writing means as seen in a moving direction of the medium, a thermal writing means for generating a latent character image by local application of heat onto the medium controlled in a character-dependent fashion, and a development means in which the latent character image is developed by inking upon utilization of the condensation of a vapor or by direct color transfer with a mechanical application means.

Advantageous embodiments of the invention include providing the further method step of the developed character image being transferred onto a recording medium in a transfer printing station. The intermediate image may be composed of a condensate which is separately inked with a color powder atomization.

In the printing apparatus, a transfer printing station for transferring the developed character image onto a recording medium may be provided. The medium, in one instance, is composed of a composite material which includes a surface layer having a high thermal conductivity perpendicular to the surface and a low thermal conductivity in a surface direction and also includes a heat-insulating carrier layer. This medium may include a surface layer having a thickness of between 30 and 300 micrometers and a carrier layer having a thickness of between 100 through 500 micrometers. The medium may be in the form of an endless belt or a drum.

The printing apparatus may also include a development space that accepts the medium in a development region and is traversed by a vapor. Such printing apparatus may also include a vapor circulation system in communication with the development space and including a liquid vapor container, a heating means for evaporating a liquid, a temperature-controlled vapor buffer space, and further include a return condensation unit which condenses the vapor conducted through the development space and supplies the condensed vapor to the liquid paper container. The printing apparatus may also include a means for conducting the vapor through the development space in a direction opposite the moving direction of the medium.

Advantageous embodiments of the invention are characterized by the subclaims.

Given a thermally stabilized medium movably conducted in a printer, a latent thermal character image is produced on the medium with a thermal writing means that, for example, can contain a laser or Peltier elements, and that is controlled in character-dependent fashion which is defined as control of the printer to produce a character to be printed when printing of the character is desired. This latent thermal character image is then exposed to vapor. In accord with the temperature distribution of the character image, the vapor condenses onto the image regions of the character image that have a temperature below the dew point of the vapor. Colored vapor or colorless vapor can thereby be employed as vapor. What is thereby understood by "colored vapor" below is both pure colored vapor, i.e. evaporated ink, as well as colorant vapor, i.e. vapor of a carrier liquid having colorant particles suspended therein.

The condensate that has precipitated on the medium and that is either colored itself as a pure colored vapor condensate or has colorant particles as a colorant vapor condensate is then transfer-printed onto a recording medium.

A transfer printing, that is only slightly influenced by the properties of the recording medium and of the colorant to be transferred, is thus achieved.

As a result of the condensation process, a differing color application in points and edges and in extended areas is completely avoided and a granularity of the image is completely avoided due to the sub-microscopic size of the vapor particles.

In a further embodiment of the invention, an oleophilic or hydrophilic, molecular liquid film is first applied on a medium that is set to an approximately uniform temperature. A latent thermal character image is then generated on the medium by selective evaporation of the liquid film with a thermal writing means that is controlled in character-dependent fashion. This latent character image is then developed in a development station by condensation of a colored vapor. The transfer of the developing character image onto individual sheets or endless paper then ensues in a transfer printing station.

It is advantageous as a medium for the latent thermal character image when it is composed of an elastic, composite material that comprises a surface layer having a high thermal conductivity perpendicular to the surface and a low thermal conductivity in a surface direction and when the surface layer is arranged on a thermally insulating carrier layer.

A latent thermal character image that is durable over a longer time span can be produced on the basis of such a composite material without having the latent thermal character image run due to heat transmission. The condensation heat released during condensation is also thereby reliably eliminated from the image surface and a reliable condensation is thereby enabled.

In a further embodiment, the character image produced by condensation can also be separately inked with the assistance of a color atomizer means.

When the latent thermal character image is inked with the assistance of a condensation means, then it is also advantageous to conduct the medium through a development space that is traversed by a vapor, this development space being in communication with a vapor circulation system. The excess vapor eliminated from the development space is condensed in this vapor circulation system and is re-supplied to an evaporator means that produces the vapor.

Especially beneficial inking conditions with respect to the latent thermal character image derive when the vapor and the medium move in opposite directions in the development space (counter-flow principle).

What is to be understood below by the term recording medium is both paper or any other printable material. For example, this material can also be a textile web or a plastic web.

Figure 2:
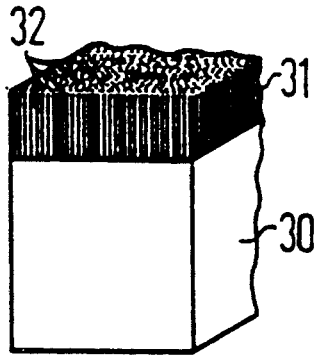
Figure 3:
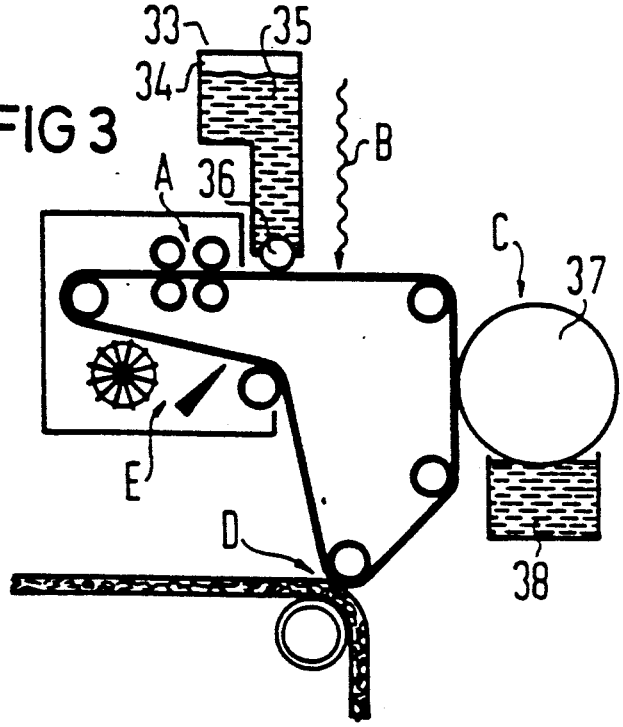

Embodiments of the invention are shown in the drawings and shall be set forth in greater detail below by way of example. Shown are:

FIG. 1 a schematic, sectional view of a printer means having a condensation developer means;

FIG. 2 a schematic, sectional view of a recording medium structure composed of composite material; and FIG. 3 a schematic, sectional view of a printer means having a wetting means with which an oleophilic or hydrophilic molecular liquid film is applied on the recording medium and wherein the transfer printing ensues with the assistance of an inking drum.

A printer means that is only schematically shown here contains a belt-shaped medium (intermediate carrier 10) of composite material that is guided electromotively driven via deflection rollers 11. However, a correspondingly dimensioned drum is also possible. The intermediate carrier 10 is fashioned as an endless circulating belt and is composed of an elastic composite material whose structure shall be set forth later. The various units of the printer are grouped around this intermediate carrier 10. These are essentially composed of a cooling means A with which the intermediate carrier is brought to a defined temperature, of a thermal writing means B for generating a latent thermal character image, of a developer means C for inking the latent thermal character image, of a transfer printing means D for transferring the inked, latent thermal character image onto a recording medium 26, for example, a paper web, and of a cleaning means E that cleans the recording medium 26 of color residues.

The structure and the function of these units shall be set forth below with references to the various method steps of the printing process.

Cooling Means

In a first method step, the intermediate carrier moved in the printer with the assistance of electromotively driven deflection rollers 11 is brought to a uniform temperature with the cooling means A. Given the employment of water as color-carrying liquid, this temperature is between 0° and 20° C., preferably 10° through 15° C. The cooling means is thereby composed of one through three cooled pairs 13 of pressure rollers that manage a uniform temperature of the recording medium. However, the cooling can also be carried out contact-free, for example with an air stream.

Thermal Writing Means

The image areas that are not to be inked are heated to a temperature between 60° and 120° C., preferably 80° through 100° C., with a thermal writing means. High-energy, electromagnetic radiation that is absorbed as completely as possible by the material of the belt is suitable for the writing, i.e. the local heating of those areas that are not to be inked imagewise. For example, this can be offered with $CO_2$ wave guide lasers or high-temperature lamps. The deflection and focusing optics known, for example, from laser printers and disclosed, for example, in U.S. Pat. No. 4,311,723 is used for generating the image pattern when a laser is employed. A PLZT switching optics whose structure can be derived from German Published Application 36 23 487 is meaningful, for example, given high-temperature lamps. However, the writing means can also be composed of laser diode arrays, of microwave elements or of pin electrode arrays.

All of these elements are used to generate a latent thermal character image that is composed of individual heat points, whereby the drive of the thermal writing means can ensue via a standard character generator (not shown here) as may be derived, for example, from U.S. Pat. No. 4,311,723.

It is also possible to generate the thermal character image with the assistance of a contact of Peltier elements that lie against the intermediate carrier 10 and selectively cool or heat it character-dependent in accord with the standard principle in thermo-transfer methods.

Developing Means

The latent thermal character image impressed on the intermediate carrier 10 is developed inside the developing means in that colored vapor is conducted past the intermediate carrier 10 in a counter-flow principle. To that end, the developing means comprises a closed vapor circulating system. This is composed of a liquid vapor container 14 having a heating mechanism 15 for evaporating the inking fluid 16 into a temperature-controlled vapor buffer space 17. The colored vapor flows into a development space 19 under the action of a radial blower 18, the intermediate carrier 10 being conducted through this development space 19 in vapor-tight fashion. One side wall of the development space is formed by the belt-shaped intermediate carrier 10. After the colored vapor has been conducted past the intermediate carrier opposite the moving direction thereof, the colored vapor is conveyed into the return condensation unit 21 with the assistance of a further radial blower 20 arranged at the other end of the development space 19 and is condensed in said return condensation unit 21. The condensate then drips back into the liquid vapor container 14 under the force of gravity. This liquid vapor container 14 is connected to a liquid reservoir 23 via a control valve 22.

Given an interruption in pressure, the development space is closed with an electromagnetically actuatable butterfly valve 24 arranged at the entry region of the development space 19 and, at the same time, the connection to a bypass pipe 25 that connects the output of the radial blower to the liquid vapor container 14 is opened, so that the color vapor flows back into the liquid vapor container 14.

The colored vapor flowing into the development space 19 is kept at a temperature approximately 5° below the temperature of the image-free locations of the thermal character image on the intermediate carrier 10 in order to avoid a condensation in these regions.

The degree of the color application onto the intermediate carrier 10 is mainly dependent on the relative speed between belt and vapor stream, on the temperature difference between vapor region and image region, on the thermal capacity of the belt and on the thermal conductivity of belt and liquid.

Given temperature differences of 70° through 80° and relative speeds of the belt and vapor stream of 2 through 4 m/sec., color layers of 5 through 20 $\mu$m/s are produced. This enables an extremely flexible design of the printer means for printing speeds between 0.1 through 1 m/s, since a color application of only 2 through 4 $\mu$m is required for a good print image.

However, it should be pointed out that the image can be produced both in a positive as well as in a negative process, this meaning that the written characters arise either from the non-inked parts or from the inked parts of the ink-thermal intermediate image.

In an exemplary embodiment that is not shown here, the color application in colorant powder atomization ensues only after the condensation of the carrier liquid. In this exemplary embodiment, the actual development means is followed by a further colorant powder atomizer means. In terms of structure, this colorant powder atomizer means corresponds to the traditional colorant powder atomizer systems known from powder-coating technology.

Transfer Printing Means

The transfer of the inked, thermal intermediate image ensues inside the transfer printing station D. The endless paper 26 or the textile web is thereby continuously conducted past under slight pressure at a deflection roller 27 with the speed of the intermediate carrier 10.

Given the employment of water as a carrier liquid, both endless paper as well as individually conveyed sheets of paper or, for example, textile materials having appropriate absorbency are suitable as printable recording medium 26. Given the employment of suitable liquids, however, plastics as well as metal foils can also be printed.

Cleaning Means

The cleaning of the intermediate carrier 10 after the transfer printing ensues in the cleaning means A with a stripper blade 28 and with a cleaning brush 29; at the same time, the intermediate carrier 10 is rinsed with carrier liquid.

The cleaning and the cooling of the intermediate carrier 10 to a uniform temperature can be combined, whereby the belt in an embodiment of the invention that is not shown here dips into a bath of carrier liquid brought to the desired preparation temperature during cleaning.

The described recording cycle begins anew after the cleaning.

In order to be able to reliably produce the latent thermal character image on the intermediate carrier 10, the latter is expediently composed of an elastic composite material in accord with the illustration of FIG. 2 that has a high thermal conductivity perpendicular to the surface and a lower thermal conductivity in a surface direction. For example, this thermal conductivity can be produced in that a surface layer 31 having a layer thickness between 30 and 300 μm, preferably 70 through 130 μm, is applied on a thermally insulating plastic carrier material 30, for example Mylar, having a thickness of 100 through 500 μm. For example, the surface layer 31 can contain a multitude of thin fibers 32 composed of metal or of other thermally conductive materials. These fibers 32 that proceed perpendicularly relative to the surface layer 31 are embedded in an appropriate, thermally insulating plastic of, for example, Mylar.

In an embodiment of the invention shown in FIG. 3, an optimally thin liquid film composed of an oleophilic or hydrophilic liquid is applied on to the intermediate carrier with the assistance of a liquid application means 33. This liquid application means can be composed of a container 34 that accepts the liquid 35 and that comprises a drum 36 at its lower end that transfers the liquid onto the intermediate carrier. The oleophilic or hydrophilic, extremely thin liquid film is then selectively evaporated with the above-described, thermal writing means and a latent character image is thereby produced in the liquid film. The latent character image is then developed either with the assistance of a vapor condensation developing means conforming to FIG. 1 or, on the other hand, is advantageously developed by applying color with an inking drum 37 having appertaining reservoir 38. The ink applied can thereby be either water-containing or oil-containing. Corresponding to the hydrophilic or, respectively, oleophilic image pattern on the intermediate carrier 10, the ink is picked up only in conformity with the image pattern.

The inked intermediate image is then transferred onto a recording medium 26, for example, paper 26 in the transfer printing station in the usual way.

It is has been assumed in the illustrated exemplary embodiments that the character image is first produced on a medium referred to as intermediate carrier 10 that is composed of an endless belt. Given appropriate fashioning of the medium, however, it is also possible, corresponding to an embodiment of the invention that is not shown here, to produce the character image directly on the medium that is then the recording medium itself and to subsequently ink it with the assistance of one of the described development means. The recording medium employed could thereby comprise a structural format corresponding to FIG. 2.

I claim:

1. A printing process, comprising the following method steps:

a) bringing a medium movably guided in a printer to a uniform temperature;

b) producing a latent thermal character image on the medium with a writing means that is controlled in character-dependent fashion to produce characters when desired; and c) developing the latent thermal character image to form a developed character image in a development station by one of: condensation of a colored vapor, and separate inking after condensation of a vapor, whereby condensation behavior of the vapor and temperature of the medium are selected such that the vapor precipitates on the medium to define a character to be printed in one of: a positive and negative image; and d) transferring the developed character image onto a recording medium in a transfer printing station.

2. A printing process according to claim 1, further comprising the following method step:

separately inking an intermediate image composed of vapor condensate with atomized colorant powder.

3. A printer apparatus, comprising:

a means for moving a medium through a printer;

a temperature control means for setting a temperature of the medium as the medium is moved through the printer to an approximately uniform, predetermined temperature;

a thermal writing means for generating a latent thermal character image by local application of heat onto the medium, said thermal writing means being controlled in character-dependent fashion;

a development means for developing the latent thermal character image to produce a developed character image by one of: condensation of a colored vapor to define the developed character image, and separate inking after condensation of a vapor; and a transfer printing station for transferring the developed character image onto a recording medium.

4. A printer apparatus according to claim 3, wherein said medium is composed of composite material that comprises a surface layer having a high thermal conductivity perpendicular to the surface and a low thermal conductivity in a surface direction and that comprises a heat-insulating carrier layer.

5. A printer apparatus according to claim 4, wherein said surface layer has a layer thickness of 30 through 300 μm and wherein said carrier layer has a layer thickness of 100 through 500 μm.

6. A printer apparatus according to claim 5, wherein said medium is one of: an endless belt and a drum.

7. A printer apparatus according to claim 5, wherein said development means includes means defining a developmetn space that accepts the medium in a development region and is traversed by vapor.

8. A printer apparatus according to claim 7, further comprising;

a vapor circulation system in communication with the development space and including a liquid vapor container, a heating means for evaporating a liquid and a temperature-controlled vapor buffer space, and a return condensation unit that condenses the vapor conducted through the development space and supplies the condensed vapor to the liquid vapor container.

9. A printer apparatus according to claim 7, further comprising; a means for conducting the vapor through the development space opposite the moving direction of the medium.

* * * * *